US005617678A

United States Patent [19]

Morandin et al.

[11] Patent Number: 5,617,678

[45] Date of Patent: Apr. 8, 1997

[54] EAVESTROUGH SYSTEM

[75] Inventors: George A. Morandin, Thornhill; Jerry Moscovitch, Toronto; Miro Glisch, Scarborough, all of Canada

[73] Assignee: GSW Inc., Toronto, Canada

[21] Appl. No.: 316,369

[22] Filed: Oct. 3, 1994

Related U.S. Application Data

[63] Continuation of Ser. No. 3,466, Jan. 12, 1993, abandoned.

[30] Foreign Application Priority Data

Aug. 28, 1992 [CA] Canada ..... 2077109

[51] Int. Cl.[6] ..... E04D 13/064

[52] U.S. Cl. ..... 52/11; 52/12; 248/48.2

[58] Field of Search ..... 52/11, 12, 15, 52/16; 248/48.1, 48.2

[56] References Cited

U.S. PATENT DOCUMENTS

| | | | |
|---|---|---|---|
| 803,477 | 10/1905 | Flowers | 248/48.2 |
| 2,431,012 | 11/1947 | Alig . | |
| 3,333,803 | 8/1967 | Landis | 52/11 |
| 3,341,158 | 9/1967 | Landis | 248/48.2 |
| 3,670,505 | 6/1972 | Weaver | 52/11 |
| 3,874,131 | 4/1975 | Webster . | |
| 4,610,412 | 9/1986 | Holden | 248/48.2 |
| 4,632,342 | 12/1986 | Skinner | 52/11 |
| 4,951,430 | 8/1990 | Gottlieb | 52/11 |

FOREIGN PATENT DOCUMENTS

| | | |
|---|---|---|
| 2203405 | 5/1974 | France . |
| 2217498 | 9/1974 | France . |
| 2571411 | 4/1986 | France . |
| 2572111 | 4/1986 | France . |
| 672950 | 5/1952 | United Kingdom . |
| 1448195 | 9/1976 | United Kingdom . |
| 2236776 | 4/1991 | United Kingdom . |
| 9208021 | 5/1992 | WIPO . |

*Primary Examiner*—Michael Safavi

[57] ABSTRACT

An eavestrough system utilizes a two-piece hook wherein a small clip is positioned and secured on a fascia and thereafter assembled eavestroughing and eavestrough hooks are conveniently attached thereto, preferably by means of a sliding snap fit relationship. The eavestrough hooks are slidable on the eavestrough section and can be preassembled on the eavestrough at ground level. This, in combination with the fast engagement with the clips, simplifies installation. The invention is also directed to an improved eavestrough hanger having resilient spring arms.

14 Claims, 6 Drawing Sheets

EAVESTROUGH SYSTEM

This application is a continuation of U.S. application Ser. No. 08/003,466, filed Jan. 12, 1993, now abandoned.

FIELD OF THE INVENTION

The present invention relates to eavestroughing system and in particular, an improved eavestrough hanger and an improved method of installation.

BACKGROUND OF THE INVENTION

There are a number of eavestroughing systems manufactured by Plasmo, Genova and GSW which use an extruded plastic eavestrough section in combination with hangers of different arrangements for supporting of the eavestrough from a fascia. Many of these systems use what is referred to as a "hidden" hook, that is the hook is hidden by the eavestrough and essentially supports the eavestrough either side thereof at the front and rear surfaces.

Our earlier system utilized an injection molded eavestrough hook having a central port in an upper edge used to secure the hook to the fascia. Once the hooks were installed on the fascia, the eavestrough section was suspended from an outer edge of the hook and the eavestrough section was rotated about the front of the hook, such that the rear of the eavestrough section came into engagement with a rear portion of the hanger and resulted in a snap type fit at the rear edge of the hanger. Details of this system are shown in U.S. Pat. Nos. 4,257,716, 4,632,342 and 4,901,954. With this arrangement, the eavestrough sections were supported by the eavestrough hangers at the front and rear edges and the bottom portion of the eavestrough was free of obstruction from the hangers. Other systems use a bottom support hanger, which is basically a "U" type bracket, however, these have not proven popular due to the interruption of the bottom surface of the eavestrough sections.

The use of hidden hooks attached to the fascia and the various arrangements for securing the eavestrough to the secured hangers resulted in a system which required much of the assembly to be carried out at the elevation of the fascia.

A further problem experienced with these eavestrough systems is with respect to high shock loads which can occur during winter conditions. It is possible for the eavestrough sections to fill with ice, with ice on the roof also being partially supported by the eavestrough section. This can result in high stress loads on the hangers and the hangers have been known to fail. It can be appreciated that the characteristics of the plastic change with temperature and this high load demand and cold ambient temperatures leads to a condition where the hangers can fail. Failure of one hanger creates somewhat of a domino effect, as the other hangers have to pick up the additional weight, and these too can fail.

Another winter condition which is even more of a problem is the possibility of snow or ice on the roof melting and sliding off the roof and impacting upon the eavestrough system. This is of a particular problem with metal roofs where often the snow and ice on the roof slides off and creates extremely high shock loads on the eavestrough system. This has been known to essentially strip the eavestrough system from the fascia by either ripping of the hangers directly from the fascia or causing the hangers to fail, generally adjacent the fascia.

Eavestrough hangers of what is referred to as the hidden hook design typically have a base and some sort of cantilevered "I" or "T" beam projection for engaging the front edge of the eavestrough and engaging the rear edge of the eavestrough. Therefore, the cantilevered portion has been designed to be stiff and to provide positive securement adjacent the base of the hanger. This desire to provide a rigid type hanger causes problems during the high loads discussed above.

The present invention defines an eavestroughing system which is easier to install and also defines an improved hanger.

SUMMARY OF THE INVENTION

An eavestrough hook for supporting in a hanging manner an eavestrough either side thereof according to the present invention comprises a base for securement to a fascia and two angled spring arms positioned one below the other at said base and extending outwardly therefrom and converging to an outer eavestrough hanging position. The eavestrough hanger adjacent the lower of the two angled spring arms includes an inner eavestrough hanging position. The spring arms are connected at either end and are open intermediate the arms to define a large open space therebetween which accommodates separate deflection of each spring arm.

According to an aspect of the invention, the spring arms are upwardly bowed between the inner and outer points of eavestrough securement.

An eavestrough hook according to the present invention comprises a fascia mounting clip an eavestrough support member. The clip includes a back support having a port therethrough through which a screw or other fastening arrangement can extend and engage the fascia. The back support member has a front face which cooperates with the rear face of the eavestrough support member to form a releasable connection therewith for supporting the eavestrough support member generally perpendicular to the fascia. The eavestrough support member includes mounting means engaging an eavestrough at the front and rear top edges and accommodates sliding movement of the eavestrough support member in the length of the eavestrough. The clip and the eavestrough support member cooperate, such that loads on the eavestrough hook which exceed the capacity thereof cause the clip to fail, releasing the eavestrough support member from the clip whereby the eavestrough hook can be repaired by replacing the clip. In this way, the clip and eavestrough support member cooperate to define a fused-like arrangement, causing the system to fail in a predetermined manner, given that the capacity of the system has been exceeded.

According to an aspect of the invention, the clip and eavestrough support member cooperate by means of an upwardly opening dovetail arrangement to provide a snap interlock.

According to a further aspect of the invention, the clip of the eavestrough hook has opposed downwardly converging shoulders which engage projecting shoulders of the eavestrough support in a support position of the clip and eavestrough support.

According to a further aspect of the invention, the eavestrough support member includes a base and two opposed spring arms positioned one below the other at the base and extending outwardly therefrom and converging to an outer eavestrough hanging position. The eavestrough support member adjacent the lower of the angled spring arms includes an inner eavestrough hanging position.

According to a further aspect of the invention, the eavestrough hook can be used with either a traditional style eavestrough section or a contemporary style eavestrough section having inwardly directed flanges immediately adjacent but below the upper edges of the contemporary eavestrough section.

An eavestroughing system according to the present invention comprises sections of eavestrough, eavestrough hooks for supporting the sections of the eavestrough from a fascia, and connectors for joining the lengths of eavestrough sections. Each eavestrough hook comprises a clip for mechanically fastening to a fascia, which clip has a cooperating fit with an eavestrough support member. The eavestrough support member engages the rear and front edges of the eavestrough sections and are slidable therealong. The clips are secured to the fascia and thereafter the eavestrough support members, secured to the eavestrough sections, are attached to the clips, thereby reducing the amount of assembly required to be completed at the level of the fascia.

The present invention is also directed to the method described above.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
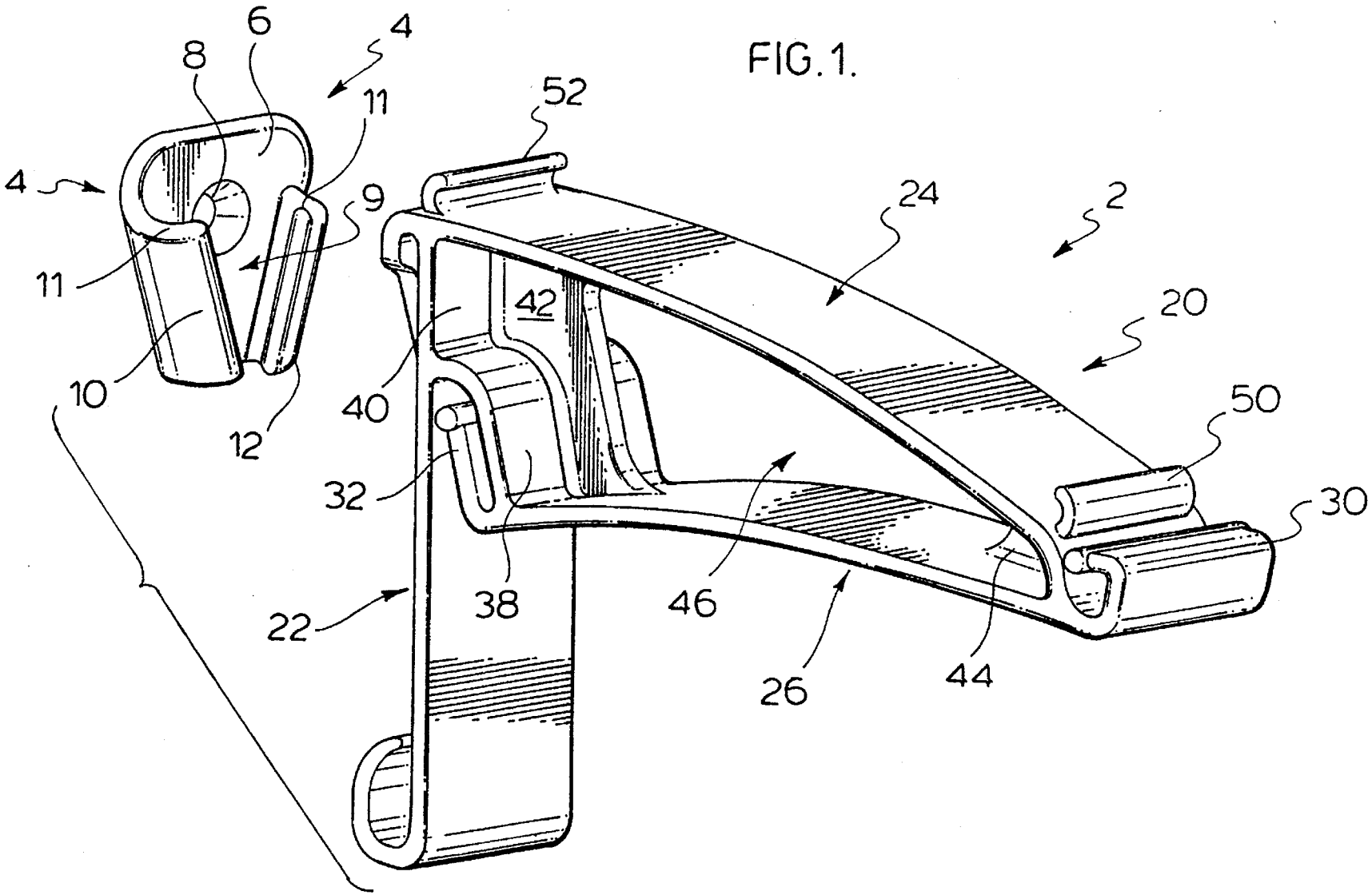
FIG. 1 is an exploded perspective view of the eavestrough hook and the two separate components thereof.

The eavestrough hook, generally shown as 2, is of the type referred to as a "hidden" hook, in that it engages the inner and outer edges of an eavestrough section and is generally concealed by the eavestrough when it is secured to a fascia. The eavestrough hook 2 includes a fascia mounting clip 4 which has a back support portion 6, a port 8 through an upper area of the back support portion which allows a screw or other mechanical fastener to pass therethrough and engage a fascia and secure the mounting clip to the fascia. The clip 4 also includes inwardly directed retaining flanges 10 and 12 which converge towards each other in a downwardly direction. These inwardly directed retaining flanges 10 and 12 define a triangular-like pocket between the retaining flanges and the back support 6. This pocket is open in the area between the retaining flanges.

The eavestrough hook 2 also includes an eavestrough support member 20. This eavestrough support member 20 is generally orientated to be perpendicular to a fascia, 120 in FIG. 5, and is designed to engage and be supported by the fascia mounting clip 4. The eavestrough support member 20 includes a base or fascia adjacent member 22, opposed spring arms 24 and 26 which are spaced at the base and converge to a front support position. The spring arms are generally secured to each other adjacent the front of the support member 20 used to support the front of the eavestrough. At the front edge of the support member 20 is an eavestrough front lip engaging member 30 which is generally "U" shaped with one arm of the "U" projecting from the front face rearwardly towards the base. The eavestrough support member also includes an eavestrough rear lip engaging member 32.

The spring arms 24 and 26 cooperate with a curved flange 38 adjacent the base 22 and a flange 40, which is part of the base 22, to form a loop type enclosure. Partial webs 42 and 44 are at the inner and outer ends of this enclosure to stiffen the same. The webs are centrally disposed and define a large opening 46 between the spring arms 24 and 26. This large opening allows each spring arm to cooperate and support the normal loads while allow some independent movement to reduce high shock loads. The spring arms also include on the upper surface leaf guard fasteners 50 and 52 which cooperate with a leaf guard, shown as 54 in FIG. 2, which can be secured to the system.

Figure 4:
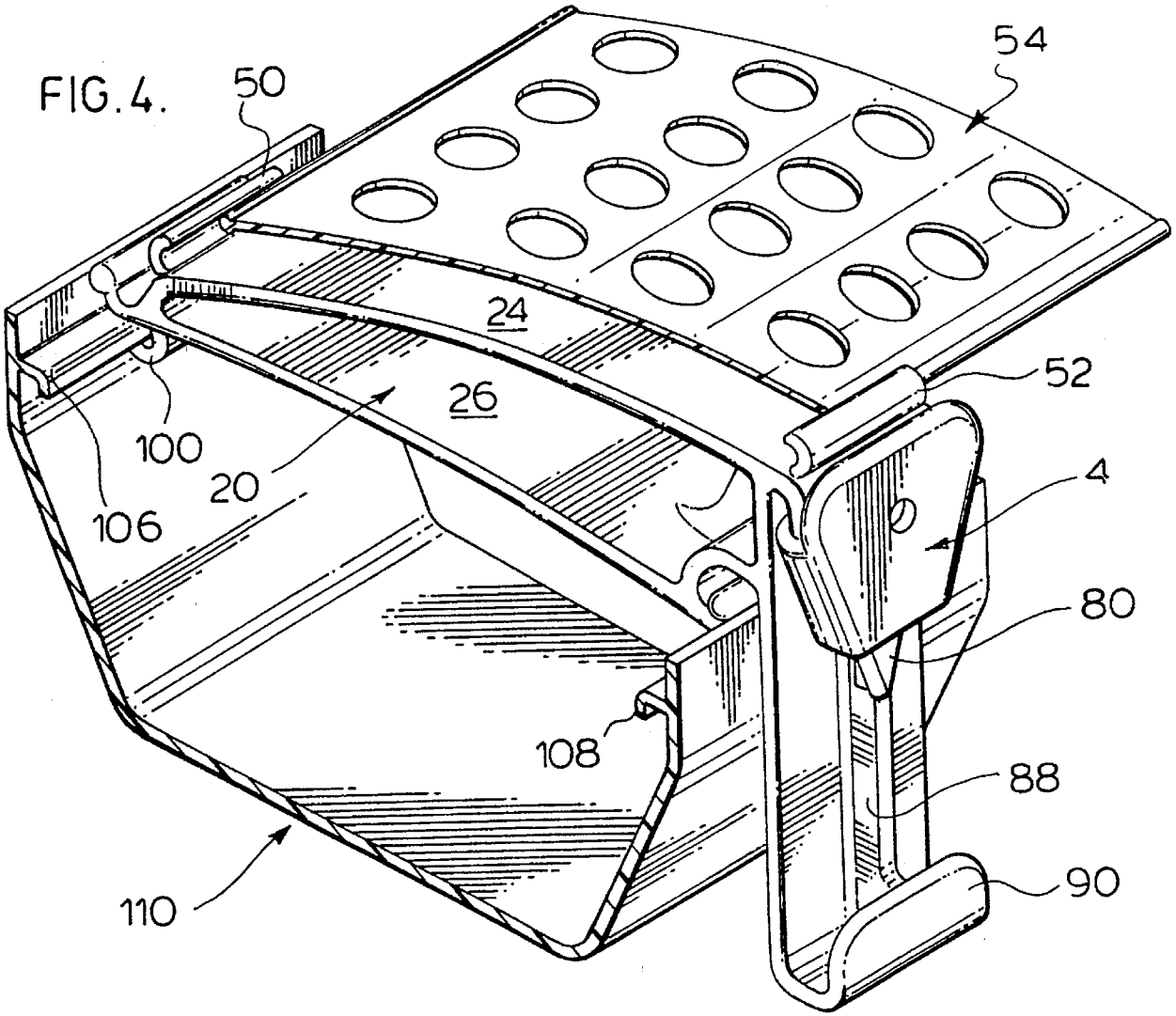
FIG. 4 is a rear perspective view of the eavestrough support member and clip with a contemporary style eavestrough section.
Figure 5:
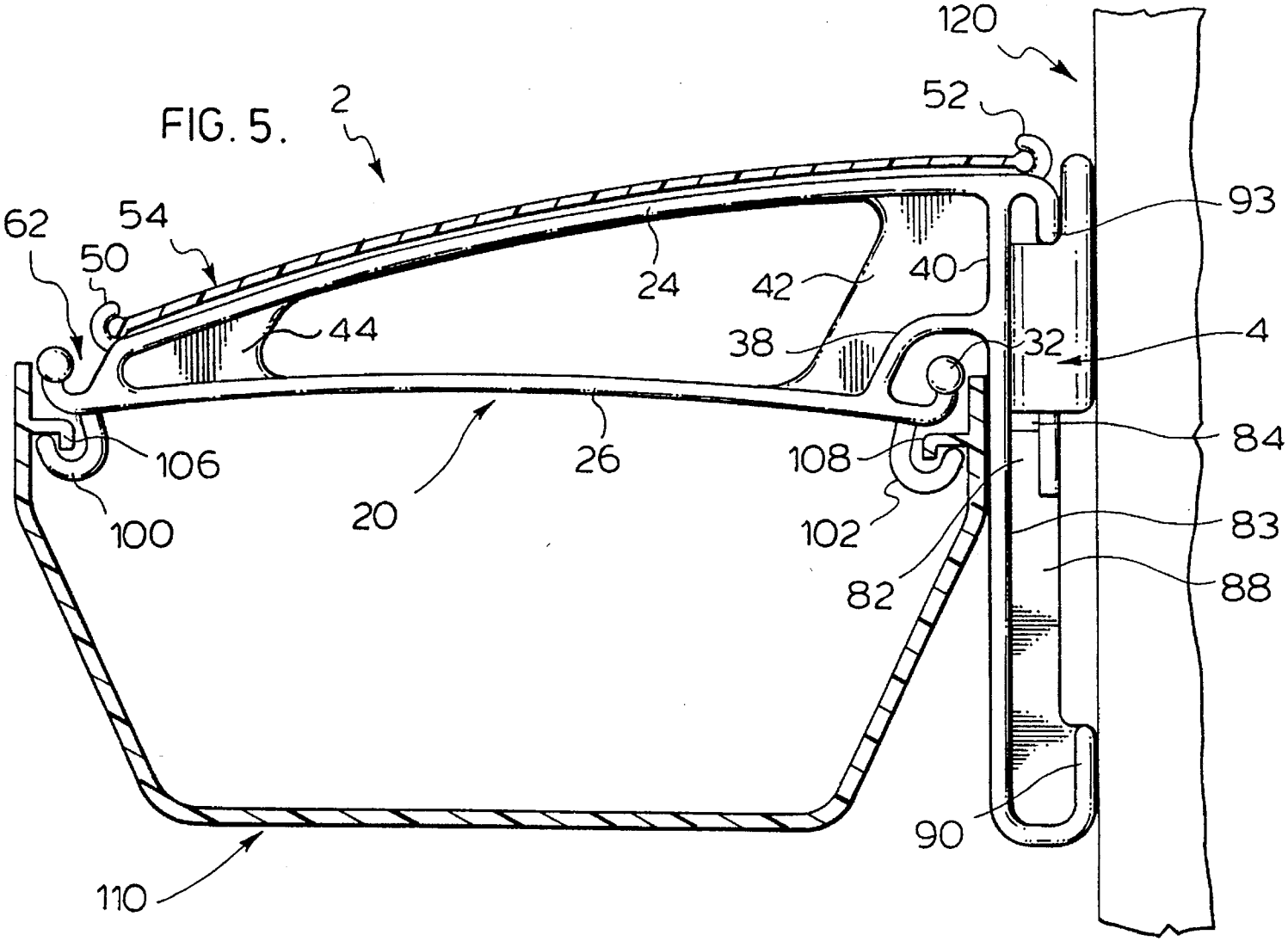
FIG. 5 is a side view of a contemporary style eavestrough section.

The spring arms 24 and 26 are upwardly bowed and must be forced through a center position which would require substantial compression of each spring member if a very large downward force was applied to the spring members. The bow in the spring members provides some give to the arrangement, although under normal operating conditions of the eavestrough hook, the spring arms remain essentially fixed. The curved upward surface of spring arm 24 also provides a broad support for the leaf guard 54 when secured to the eavestroughing system as shown in FIGS. 4 and 5.

Figure 2:
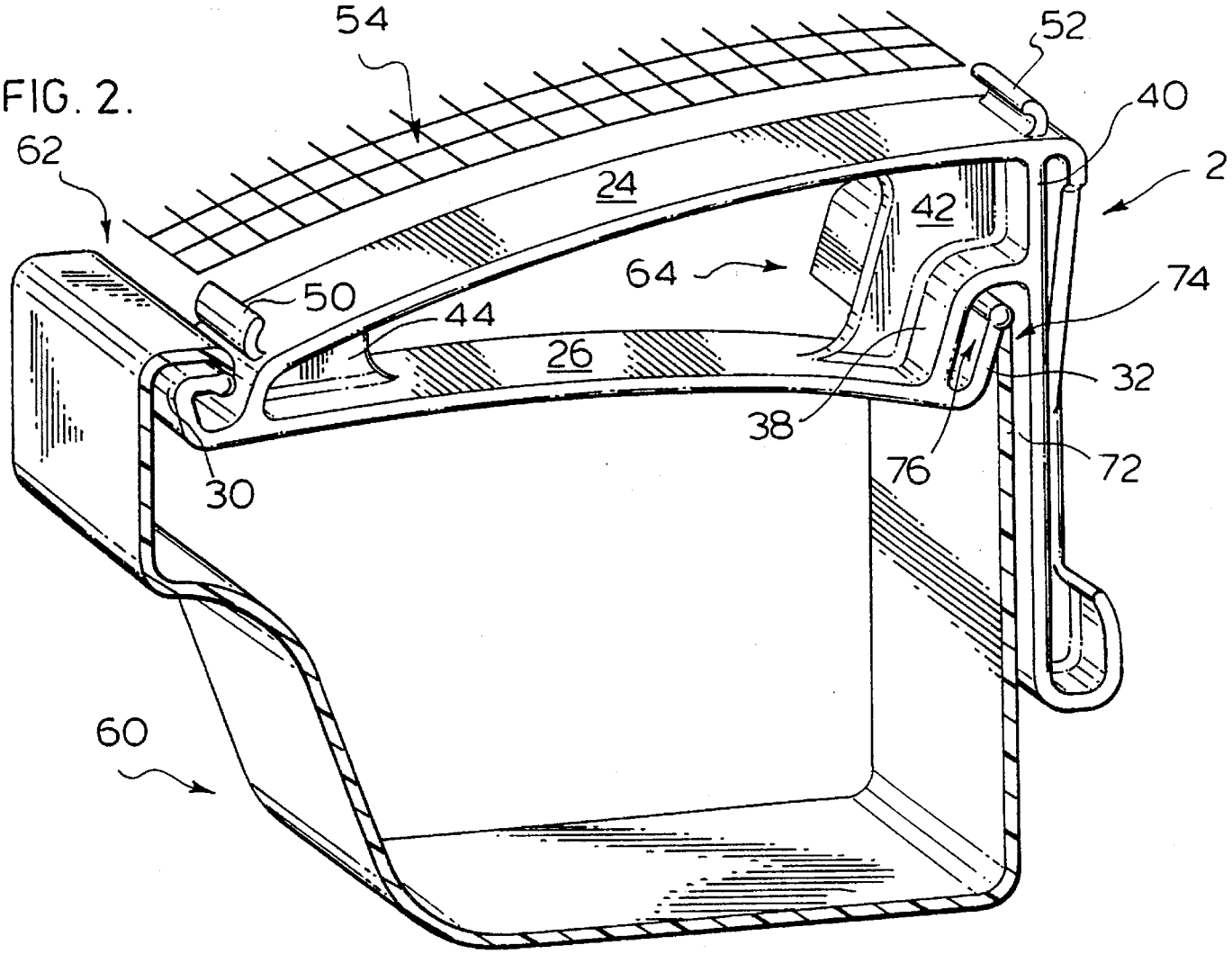
FIG. 2 is a view of the eavestrough hook engaging a contemporary style eavestrough section.

In FIG. 2, a traditional eavestrough section 60 is shown in sliding engagement with an eavestrough hook 2. A "U" shaped hook 62 is provided on the eavestrough section and is open at the interior surface facing the front wall of the eavestrough section. This "U" shaped hook cooperates with the eavestrough front lip engaging member 30 to retain the eavestrough section 60 while allowing sliding movement of the eavestrough hook 2 in the length of the eavestrough section 60. A similar sliding arrangement is provided between the "U" shaped rear downwardly opening arrangement 64 of the eavestrough section which cooperates with the eavestrough rear lip engaging member 32. The base 22 includes a front face 72 which defines a slot 74 between member 32 and the front face 72. This accommodates the thickness of the rear wall of the eavestrough section. The hook portion, i.e. member 64 of the eavestrough section, slides between the gap 76 provided between member 32 and curved flange 38 of the eavestrough hook. Basically, the hook provides member 32 within a "U" shaped slot of the eavestrough hook and the downwardly opening "U" shaped hook at the rear of the eavestrough slides within this slot.

Figure 3:
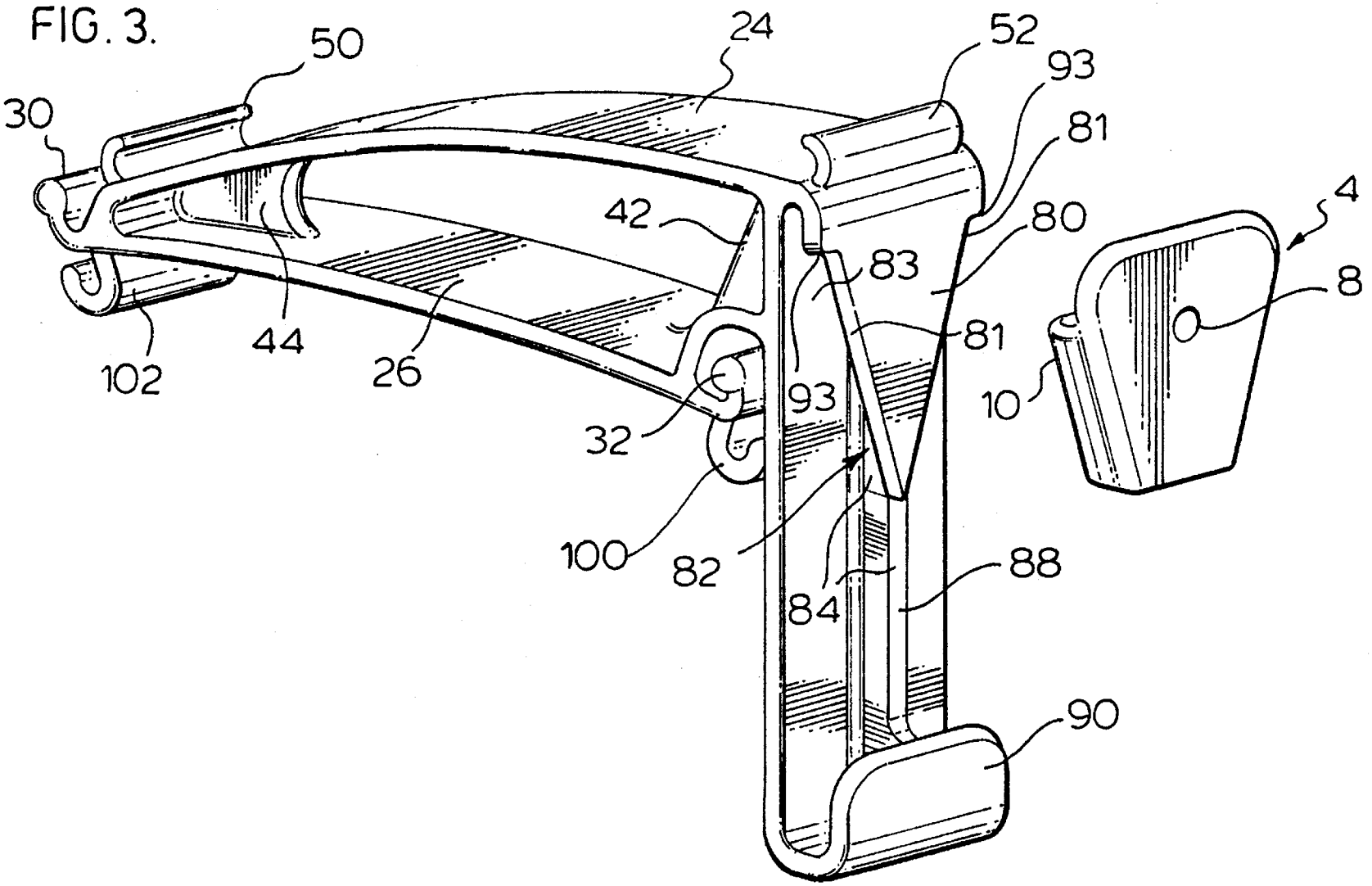
FIG. 3 is a rear perspective view of the eavestrough support member and clip.

In FIG. 3, the rear surface of the eavestrough support member is shown. It includes a bottom flange 90 which cooperates with the clip 4 to properly space the eavestrough support member from the fascia. As it can be seen, the projecting base 90 compensates for the thickness of the clip extending beyond the eavestrough support member 20. The eavestrough support member also includes a center reinforcing flange 88 running in the height of the support member which merges with a triangular dovetail portion 80. This dovetail has projecting shoulders 81 which define a slot 82 between the projecting shoulders and the interior portion or surface 83 of the rear surface of the eavestrough support member. The slot 82 is of a depth to slidably receive the retaining flanges 10 and 12 of the clip 4. The clip, due to its "V" shaped opening 9, may be positioned to receive the projecting shoulders 81 between the base 6 and the projecting flanges 10. The dovetail also includes horizontally projecting support shoulders 93 which engage the upper surfaces 11 of the projecting flanges 10 and 12 in the assembled condition. Therefore, during assembly of the system, the clip, which has been previously mounted to the fascia, first loosely receives the projecting triangular dovetail of the support member and then firmly engages the dovetail by moving the support member downwardly. Note that the port 8 of the clip has been provided generally above or mostly above the shoulders 11 and as such, any stress concentration due to supporting of the support arm engaging the shoulders is directed downwardly into the clip and does not focus or provide a high stress concentration in the area of port 8. This ensures that the material of the clip is used for effectively carrying the forces transmitted to it by the eavestrough support member 20. The clip 4 is releasably maintained in support engagement with an eavestrough section 20 by retaining stationary cams 84 partially obstructing slot 82 at the lower end thereof either side of the flange 88. Each retaining flange 10 and 12 snap past one retaining cam 84 and is thereby releasably maintained in the support position illustrated in FIG. 5.

In assembling this system, the clips 4 are attached to a fascia and are properly aligned to provide an appropriate grade. The eavestrough support members 20 are brought into engagement with the eavestrough section 60 and generally appropriately spaced in the length of the eavestrough section. A leaf guard may be installed at the same time at ground level and, thus, the eavestrough support members 20 and the eavestrough section 60, and the leaf guard may all be attached prior to securement of these components to the clips 4 which will previously be secured to the fascia. Once these components are assembled on the eavestrough section, the section or entire unit is carried to the height of the eavestrough clips 4 and several of the hangers may be secured to the appropriate clips. If the eavestrough section is supported in generally the middle position by a user, he can carry the eavestrough section to the appropriate height, attach one eavestrough support member to a center clip and attach the eavestrough support members to either side thereof to the appropriate clips. In this way, the entire unit will then be temporarily supported from the fascia. He can then move his ladder to effect securement of the remaining eavestrough support members. One eavestrough support member may be sufficient to support the entire system temporarily during installation, however, it has been found that it quite convenient for the installer to attach the three and thus makes the system much more stable. There is no problem with respect to alignment or proper grade on the eavestrough section, as the hooks can slide along the length of the eavestrough to make an appropriate engagement with the clip and the clips have been prepositioned at the appropriate level. Thus, one person can easily and conveniently install the system. Any expansion joints, such as shown in FIG. 6, can then be installed easily due to the sliding relationship of the hooks on the eavestrough section.

In FIG. 4, two additional components are shown projecting downwardly from the lower spring arm 26 and these are lower rear retaining hook 100 and lower front retaining hook 102. These hooks cooperate with inwardly directed flanges 106 and 108 of the contemporary style eavestrough section 110, shown in FIGS. 4 and 5. Again, there is a sliding relationship between the eavestrough section and hooks. With the eavestrough support member of FIGS. 4 and 5, either style eavestrough section may be secured by this hook. Note that the lower rear and lower front retaining hooks 100 and 102 are within the eavestrough section when a traditional style eavestrough section is used. Therefore, the hook as shown in FIG. 4 is compatible with either the traditional style eavestrough section of FIG. 2 (K style) or the contemporary style section of FIG. 5.

Figure 6:
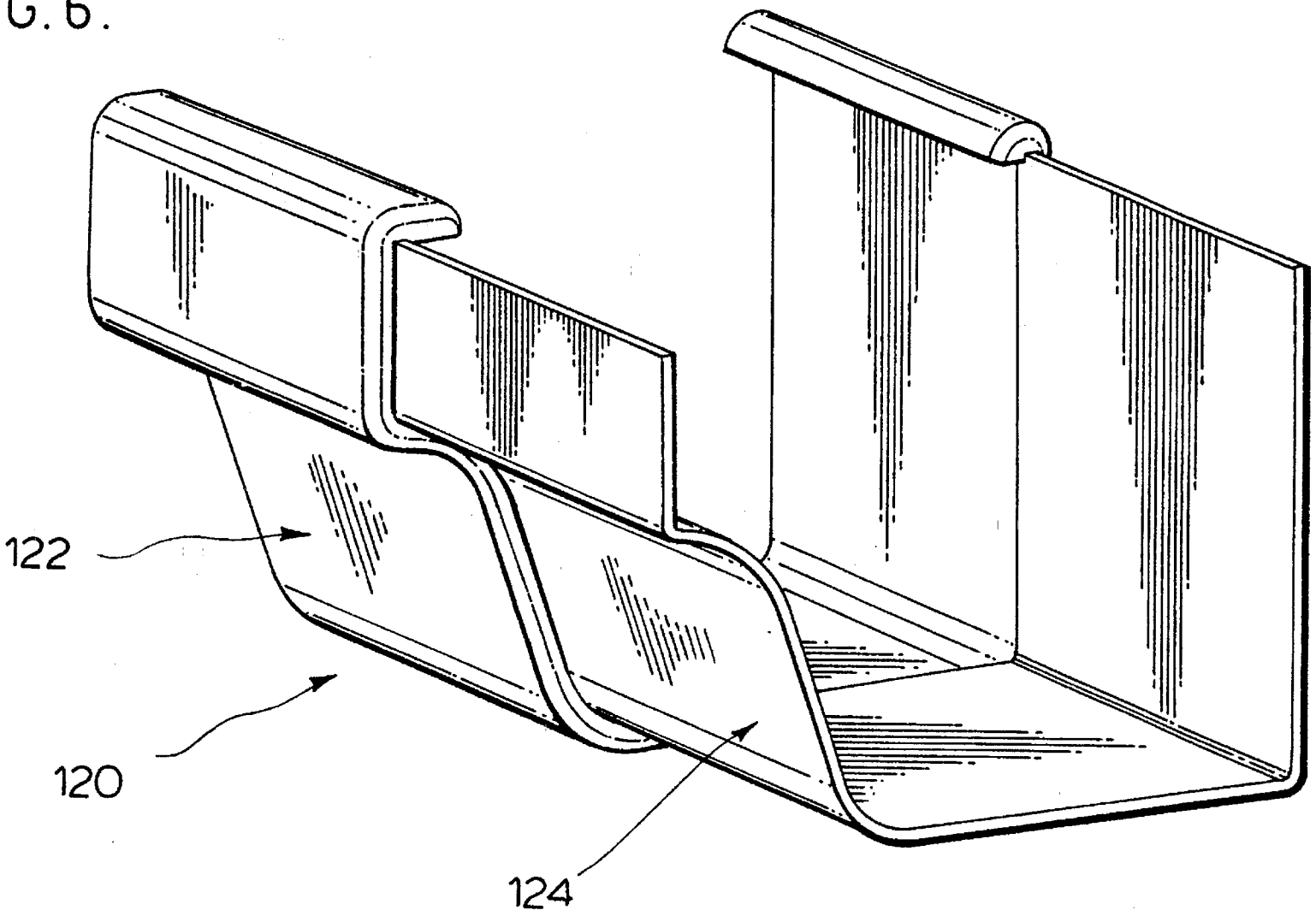
FIG. 6 is a perspective view of an expansion connection for a traditional style eavestrough section.

With plastic eavestrough sections, a substantial thermal expansion can occur and the expansion joint of FIG. 6 can be used between eavestrough sections. The expansion joint 120 effectively slides between two eavestrough sections. One end of the expansion joint 120, namely the upstream end 122, has an outer engaging sleeve type section which goes around the bottom surface of the upstream eavestrough section. The expansion joint also includes a downstream engaging section 124 which goes within the downstream section of the eavestrough. With this arrangement, water will flow from the upstream section to the downstream section under the influence of gravity and minor leakage could occur between the upstream eavestrough section and portion 122, however, gravity tends to reduce this effect and the degree of overlap is high, again reducing this possibility. A loose seal can be provided if necessary. Water which enters the expansion connector due to the influence of gravity will flow out of the downstream portion 124 and on to the downstream eavestrough section. This occurs as the inner section 124 is inside the downstream eavestrough section, and water will continue to flow under the influence of gravity from this inner section 124 to the downstream section. Again, leakage could occur between section 124 and the downstream section of eavestrough, but this is reduced due to gravity and the tendency for water to flow away from the expansion joint. This expansion joint provides a very simple and easy to use arrangement for accommodating thermal expansion of the eavestrough. Very light seals can be used if leakage becomes a problem. The expansion joint is oversized and therefore accommodates thermal expansion or contraction with the sections sliding within the joint.

With the eavestrough hook as shown in the drawings comprising the clip and the eavestrough support member, several advantages are realized. First, the installation of the system is greatly simplified, as the clips are first attached to the fascia at the appropriate points and levels and essentially the eavestrough section other than the clips is assembled on the ground and carried to the height of the eavestrough section in an assembled manner. The simple snap relationship between the eavestrough support member and clips allows easy and effective securement of the eavestroughing system to a fascia. A further advantage has been realized with this system. It has been found that high shock loads which can occur to an eavestrough system are partially absorbed by the spring arms 24 and 26. If the effective force transmitted to the eavestrough hook exceeds the capacity of the system, the clip and the eavestrough support member have been designed to accommodate the eavestrough support member being stripped from the clip. This can result in destruction of the clip, however, the structure of the eavestrough support member remains essentially unchanged. Therefore, if a home owner has this problem, he may then merely replace the clips on the fascia and reinstall the eavestrough system. The expansion joints also isolate adjacent sections whereby only the affected section may be stripped. Such high shock loads which can destroy essentially any eavestroughing system projecting from the roof can occur, particularly with metal roofs where there is a tendency of snow and ice to build on the roof and then suddenly release, striking any eavestroughing system in its way. With this arrangement, the fascia is retained. The system may be reinstalled by replacing any clips which are damaged.

Typically, contractors have preferred to use aluminum eavestroughing systems rather than plastic systems due to the speed of installation. Although the former plastic systems have been satisfactory for the home handyman, they have been too time consuming for the general contractor and, therefore, plastic eavestroughing systems have not enjoyed popularity with respect to contractors. With the system of the present invention and its ability to be assembled on the ground, and easily installed by one person, it is more attractive to contractors and can effectively compete with aluminum systems. Typically, the product for contractors will be available in longer lengths of eavestrough section, typically anywhere from 20 to 25 feet. Presently, most home handymen installed systems use eavestrough sections of approximately 10 feet in length.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In combination, a plastic eavestrough hook and an eavestrough, said plastic eavestrough hook supporting in a hanging manner said eavestrough on either side thereof, said eavestrough hook having a base for securement to a facia, two angled spring arms positioned one below the other at said base and integral therewith, said spring arms extending outwardly from said base and converging to an outer eavestrough hanging position where said arms are integrally connected, said eavestrough hook adjacent the lower of said angled spring arms including aft inner eavestrough hanging position, said spring arms being connected at either end and open intermediate to define a large open space therebetween which accommodates separate deflection of each spring arm, said inner and outer eavestrough hanging positions each including a connection by means of which said eavestrough is hung from said eavestrough hook and accommodates sliding movement of the eavestrough relative to the eavestrough hook in a direction generally along the length of the eavestrough.

2. In combination as claimed in claim 1 wherein said clip includes two opposed retaining arms which are positioned forwardly of said back support and define a downwardly converging slot arrangement which is open at the bottom thereof and open between said opposed retaining arms, said eavestrough hook including at a rear surface a generally 'V' shaped projection for receipt in said slot arrangement with opposed shoulder projection which engage an upper surface of said retaining arms to define the extent to which said 'V' shaped projection is received in said slot arrangement.

3. In combination as claimed in claim 2 wherein said clip and said 'V' shaped projection include a releasable lock for maintaining said components in an assembled condition.

4. A plastic eavestrough hook for supporting in a hanging manner an eavestrough on either side thereof, said eavestrough hook having a base for securement to a facia, two angled spring arms positioned one below the other at said base and extending outwardly therefrom and converging to an outer eavestrough hanging position, said eavestrough hook adjacent the lower of said angled spring arms including an inner eavestrough hanging position, said spring arms being connected at either end and open intermediate to define a large open space therebetween which accommodates separate deflection of each spring arm, and wherein said spring arms are upwardly bowed between said inner and outer points of securement.

5. A plastic eavestrough hook comprising a one-piece facia mounting clip and a one-piece eavestrough support member, said clip including a back support having a port therethrough through which a screw or other fastening arrangement can extend and engage the facia, said back support having a front face which cooperates with a rear face of said eavestrough support member to form a releasable connection therewith for supporting said eavestrough support member generally perpendicular to such facia, said eavestrough support member including mounting means for engaging an eavestrough at the front and rear top edges and accommodate sliding movement in the length of the eavestrough, and wherein said clip and said eavestrough support member cooperate by means of an upwardly opening dovetail arrangement.

6. An eavestrough hook as claimed in claim 5 wherein said clip has opposed, downwardly converging shoulders which engage projecting shoulders of said eavestrough support in the support position of said clip and eavestrough support.

7. An eavestrough hook as claimed in claim 6 wherein said eavestrough support member includes a base and an upper and lower opposed spring arms connected to said base in a vertically spaced manner and extending outwardly from said base and converging to an outer eavestrough hanging position, said eavestrough support member adjacent said lower spring arm including an inner eavestrough hanging position.

8. An eavestrough hook as claimed in claim 7 wherein said spring arms are connected at either end and are open intermediate said spring arms to define a large open space which accommodates separate deflection of each spring arm.

9. An eavestrough hanger as claimed in claim 8 wherein said spring arms are upwardly bowed between said inner and outer points of securement.

10. A plastic eavestrough hook as claimed in claim 5 wherein said clip includes two opposed retaining arms which are positioned forwardly of said back support and define a downwardly converging slot arrangement which is open at the bottom thereof and open between said opposed retaining arms, said eavestrough hook including at a rear surface a generally 'V' shaped projection for receipt in said slot arrangement with opposed shoulder projection which engage an upper surface of said retaining arms to define the extent to which said 'V' shaped projection is received in said slot arrangement.

11. A plastic eavestrough hook as claimed in claim 10 wherein said clip and said 'V' shaped projection include a releasable lock for maintaining said components in an assembled condition.

12. An eavestrough system comprising sections of eavestrough, eavestrough hooks for supporting the sections of eavestrough from a facia, and connectors for joining said lengths of eavestrough sections, each eavestrough section having in cross section a front edge and a rear edge, each eavestrough hook comprising a clip for mechanical fastening to a facia which clip cooperates with a mounting surface of an eavestrough support member to define a slide locking fit therebetween, said eavestrough support member engaging and supporting the rear and front edges of the eavestrough sections and are slidable therealong, said clips being secured to said facia and thereafter said eavestrough support members secured to said eavestrough sections are attached to said clips thereby reducing the amount of assembly required to be completed at the level of the facia, and wherein each eavestrough support member has opposed upwardly bowed spring arms which are integrally joined at a position adjacent said front edge of an associated eavestrough section and are vertically spaced adjacent said mounting surface and are integral therewith.

13. An eavestrough system as claimed in claim 12 wherein said clip includes two opposed retaining arms which are positioned forwardly of said back support and define a downwardly converging slot arrangement which is open at the bottom thereof and open between said opposed retaining arms, said eavestrough hook including at a rear surface a generally 'V' shaped projection for receipt in said slot arrangement with opposed shoulder projection which engage an upper surface of said retaining arms to define the extent to which said 'V' shaped projection is received in said slot arrangement.

14. An eavestrough system as claimed in claim 13 wherein said clip and said 'V' shaped projection include a releasable lock for maintaining said components in an assembled condition.

* * * * *